US010864716B2

(12) United States Patent
Zirilli

(10) Patent No.: US 10,864,716 B2
(45) **Date of Patent: *Dec. 15, 2020**

(54) VAPOR DEPOSITION AND RECOVERY SYSTEMS FOR INK-BASED DIGITAL PRINTING

(71) Applicant: Xerox Corporation, Norwalk, CT (US)

(72) Inventor: Francisco Zirilli, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/708,586

(22) Filed: Dec. 10, 2019

(65) Prior Publication Data

US 2020/0108595 A1 Apr. 9, 2020

Related U.S. Application Data

(63) Continuation of application No. 15/904,941, filed on Feb. 26, 2018, now Pat. No. 10,538,076.

(51) Int. Cl.

| | |
|---|---|
| ***B41F 7/32*** | (2006.01) |
| ***B41F 7/30*** | (2006.01) |
| ***B41F 7/02*** | (2006.01) |

(52) U.S. Cl.

CPC ..... *B41F 7/32* (2013.01); *B41F 7/02* (2013.01); *B41F 7/30* (2013.01)

(58) Field of Classification Search

None

See application file for complete search history.

(56) References Cited

U.S. PATENT DOCUMENTS

| | | | | |
|---|---|---|---|---|
| 9,019,329 | B2 | 4/2015 | Zirilli et al. | |
| 9,227,389 | B1 | 1/2016 | Zirilli | |
| 9,387,661 | B2 | 7/2016 | Zirilli | |
| 10,538,076 | B2 * | 1/2020 | Zirilli | B41F 7/02 |
| 2012/0103212 | A1 | 5/2012 | Stowe et al. | |
| 2013/0247788 | A1 | 9/2013 | Liu et al. | |
| 2015/0029292 | A1 * | 1/2015 | Zirilli | B41J 2/175 347/225 |

* cited by examiner

*Primary Examiner* — Joshua D Zimmerman
(74) *Attorney, Agent, or Firm* — Caesar Rivise, PC

(57) ABSTRACT

A dampening fluid recycling system may include a print station having an imaging member with a reimageable surface, a dampening fluid deposition subsystem for applying a layer of dampening fluid onto the reimageable surface, and a dampening fluid recovery subsystem configured to remove excess dampening fluid vapor that does not condense over the reimageable surface. The dampening fluid deposition subsystem may include a dampening fluid supply chamber, a dampening fluid supply channel, and a dampening fluid supply channel outlet. The dampening fluid supply chamber may include an inlet tube and a tube body that may be a split tube. The dampening fluid supply channel may attach to the split tube and descend towards the imaging member to deliver fluid vapor from both parts of the first split tube onto the reimageable surface of the imaging member.

20 Claims, 8 Drawing Sheets

VAPOR DEPOSITION AND RECOVERY SYSTEMS FOR INK-BASED DIGITAL PRINTING

CROSS-REFERENCE TO RELATED APPLICATIONS

This application is a continuation of U.S. patent application Ser. No. 15/904,941, filed Feb. 26, 2018, now U.S. Pat. No. 10,538,076, entitled "Vapor Deposition and Recovery Systems for Ink-Based Digital Printing".

FIELD OF DISCLOSURE

The disclosure relates to ink-based digital printing. In particular, the disclosure relates to printing variable data using an ink-based digital printing system that includes a dampening fluid vapor deposition and recovery system for enhanced dampening fluid delivery.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing as discussed in this disclosure uses a variable data digital lithography printing system, or digital offset printing system. A "variable data digital lithography system" is an image forming system that is configured for lithographic printing using lithographic inks and based on digital image data, which may be variable from one image to the next. "Variable data lithography printing," or "digital ink-based printing," or "digital offset printing" are terms that may be generally interchangeably employed to refer to the processes of lithographic printing of variable image data for producing images on a wide latitude of image receiving media substrates, the images being changeable with each subsequent rendering of an image on a substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. Publication No. US 2012/0103212A1 ("212 Publication"), entitled "Variable Data Lithography System," filed on Apr. 27, 2011, by Timothy Stowe et al., which is commonly assigned.

Variable data lithographic printing system and process designs must overcome substantial technical challenges to enable high quality, high speed printing. For example, digital architecture printing systems for printing with lithographic inks impose stringent requirements on subsystem materials, such as the surface of the imaging plate, ink used for developing an ink image, and dampening fluid or fountain.

Fountain solutions or dampening fluids, such as octamethylcyclotetrasiloxane "D4" or cyclopentasiloxane "D5" may be applied to the reimageable surface of the imaging member that may be in the form of a printing plate or an intermediate transfer blanket. Subsequently, the applied layer of dampening fluid is image-wise vaporized according to image data to form a latent image in the dampening fluid layer, which may be about 0.5 microns in thickness, for example. During the laser imaging (vaporization) process, the base marking material layer is deposited in a uniform layer, and may spread across the background region, allowing subsequently applied ink to selectively adhere to the image regions. A background region may include D4 between the reimageable surface or plate and the deposited ink. A thickness of the dampening fluid layer may be preferably around 0.2 microns, or more broadly in a range of about 0.05 and about 0.5 microns.

The laser used to generate the latent image in the dampening fluid layer creates a localized high temperature region that is at about the boiling point of the dampening fluid, e.g., about 175° C. Accordingly, during the imaging process, large temperature gradients are formed on the reimageable surface of the imaging member in the imaged areas. The surface temperature rapidly decreases to ambient temperature away from the imaged areas or imaging zones, i.e., the portion of the reimageable surface of the imaging member on which the imaging (laser imaging) takes place.

Due to a motion of the imaging member surface during printing, dampening fluid vapor has been found to migrate over cooler regions of the imaging member surface, allowing the vapor to re-condense on the imaging surface. If re-condensation occurs over an imaged region of the imaging member surface, streaks may appear in the printed image. Dampening fluid vapor must be removed before it re-condenses on the imaging member surface. Related art dampening fluid vacuum recovery systems are limited to low process speeds, for example, less than 500 mm/s.

A consistent thickness of a dampening fluid layer formed on the reimageable surface of an imaging member, and inhibiting a variability of the thickness of the disposed layer over the reimageable surface of the imaging member, or over the plate surface, is critical to effective high-quality image printing operations. To obtain a uniform dampening fluid layer thickness, reimageable surface or plate surface conditions must be satisfied. For example, under suitable conditions, a reimageable surface of the imaging member may be characterized by uniform temperature, and concentration of the dampening fluid may be uniform, and a mixture velocity tangential to the reimageable surface of the imaging member or imaging plate motion may be uniform.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

Systems and methods are provided that enable uniform dampening fluid flow onto a surface of an imaging member or plate. For example, a dampening fluid recycling system useful for printing with an ink-based digital image forming apparatus may include a print station having an imaging member with a reimageable surface, a dampening fluid deposition subsystem for applying a layer of dampening fluid onto the reimageable surface, and a dampening fluid recovery subsystem configured to remove excess dampening fluid vapor that does not condense over the reimageable surface. The deposition subsystem may include a dampening fluid source configured to provide dampening fluid in a vapor state to the reimageable surface, a dampening fluid supply chamber having a dampening fluid supply chamber interior, the dampening fluid supply chamber including an inlet tube in contact with the dampening fluid source and a tube portion extending to a closed distal end thereof, the dampening fluid supply chamber interior defined by the inlet tube and the tube portion, a dampening fluid supply channel defining a dampening fluid supply channel interior in communication with the dampening fluid supply chamber interior, the dampening fluid supply channel descending towards the imaging member, the dampening fluid supply channel being configured to deliver fluid vapor from the dampening fluid supply chamber interior onto the reimageable surface of the imaging member, a dampening fluid supply channel outlet configured to enable the dampening fluid supply chamber interior to communicate with the reimageable surface of the imaging member, and a vapor flow restriction border configured to confine dampening fluid vapor provided from the dampening fluid supply channel outlet to a condensation region to support forming the layer of dampening fluid on the reimageable surface via condensation of the dampening fluid vapor over the reimageable surface. The dampening fluid recovery subsystem may include a seal unit having a front seal portion, the front seal portion having an upper wall facing the reimageable surface, the upper wall being configured to define an air flow channel with the reimageable surface, a vapor extraction channel defining a vapor extraction channel interior in communication with the air flow channel, the vapor extraction channel ascending away from the imaging member to deliver the excess dampening fluid vapor from the air flow channel, and a vapor extraction manifold including a vapor extraction chamber defining a vapor extraction chamber interior in communication with the vapor extraction channel interior to collect the excess dampening fluid vapor from the vapor extraction channel, the vapor extraction manifold further including a vapor condensation device configured to cool the excess dampening fluid vapor into a fluid state, the vapor extraction manifold including a dampening fluid output conduit configured to deliver the cooled dampening fluid to the dampening fluid source.

According to aspects illustrated herein, a dampening fluid recycling system may include a dampening fluid source, a dampening fluid distribution manifold in fluid communication with the dampening fluid source, and a plurality of the print stations. Each print station is supplied with a mixture of air and D4 vapor with a known flow and concentration. This can be achieved with a dual supply manifold each providing the mixture flow to the print stations. A 14 inch wide print version of this manifold is also discussed. In order to provide the same amount of D4 vapor and air mixture, each of the distribution manifolds is designed such that the area ratio of port to manifold cross section is less than ~0.8. The mixture is then delivered to the imaging device of each print station at a known D4 vapor mass fraction and flow rate. Each print station may have a patterning device (e.g., laser system) to evaporate the D4 film on the imaging member in an image wise manner. The resulting D4 vapor from the evaporation process may be collected by a vapor recovery subsystem. The vapor removed is collected in a manifold having a number of hoses which in turn may connect to a single vacuum source. The D4 vapor flows over a cooling coil which may be wound over a copper core. Coolant such as water at a known flow rate may flow through the coil which causes the D4 vapor to condense. The collected condensate may pass through a filter and return to a D4 supply reservoir to be used again in the printing process. This vapor recovery subsystem ensures that none of the D4 vapor is released to the atmosphere.

The foregoing and/or other aspects and utilities embodied in the present disclosure may be achieved by providing a dampening fluid delivery system useful for printing with an ink-based digital printing system, with the dampening fluid delivery system including a dampening fluid supply chamber, a dampening fluid supply channel, and a dampening fluid supply channel outlet. The dampening fluid supply chamber defines a dampening fluid supply chamber interior, with the dampening fluid supply chamber including an inlet tube and a split tube having a first split tube portion and a second split tube portion extending to a closed distal end of the split tube, the inlet tube coupled to a dampening fluid supply source, the inlet tube extending from the fluid supply source and splitting into the first split tube portion and the second split tube portion, the first and second split tube portions rejoining at the closed distal end, the dampening fluid supply chamber interior defined by the inlet tube and the split tube, the first split tube portion defining a first split tube portion interior, the second split tube portion defining a second split tube portion interior, the first split tube portion interior being in fluid communication with the second split tube portion interior at both the inlet tube and the distal end. The dampening fluid supply channel may attach to the split tube, with the dampening fluid supply channel defining a dampening fluid supply channel interior in communication with the dampening fluid supply chamber interior, the dampening fluid supply channel descending towards the imaging member, the dampening fluid supply channel being configured to deliver fluid vapor from both the first split tube portion and the second split tube portion onto the reimageable surface of the imaging member. The dampening fluid supply channel outlet is configured to enable the dampening fluid supply chamber interior to communicate with the reimageable surface of an imaging member.

Exemplary embodiments are described herein. It is envisioned, however, that any system that incorporates features of systems described herein are encompassed by the scope and spirit of the exemplary embodiments.

BRIEF DESCRIPTION OF THE DRAWINGS

Various exemplary embodiments of the disclosed systems, apparatuses, mechanisms and methods will be described, in detail, with reference to the following drawings, in which like referenced numerals designate similar or identical elements, and.

DETAILED DESCRIPTION

Figure 1:
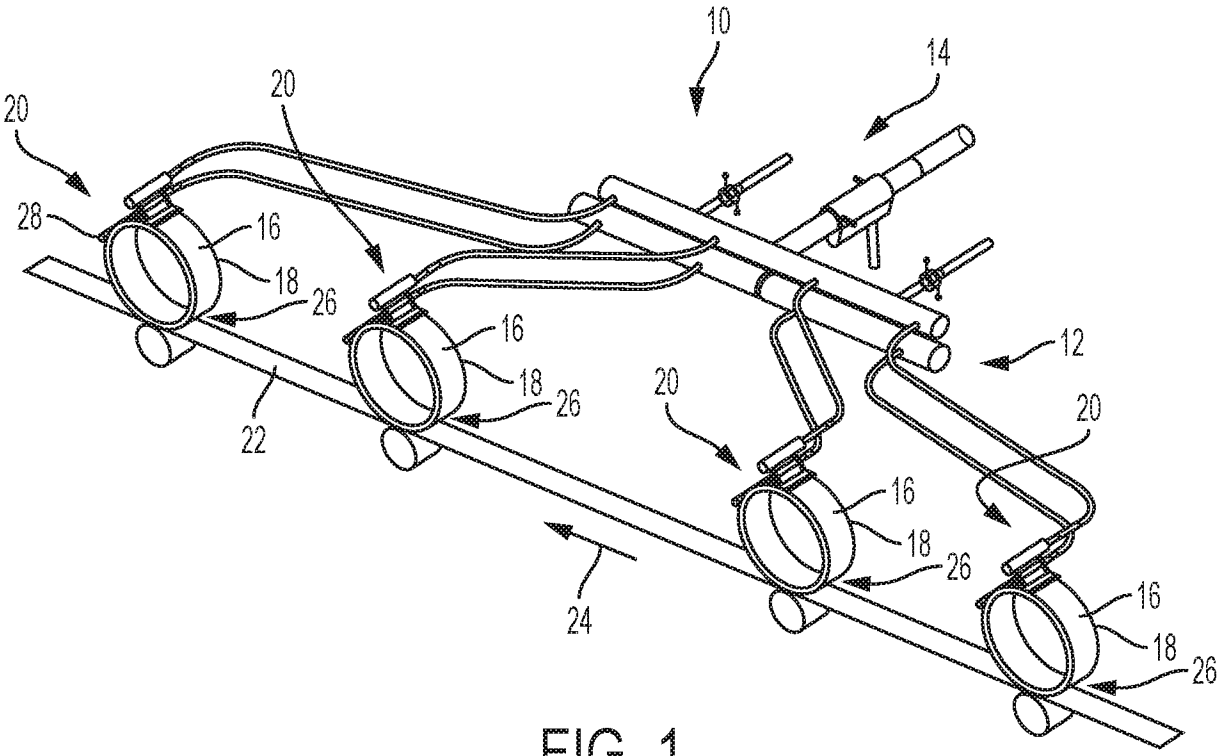
FIG. 1 illustrates a perspective view of an exemplary dampening fluid recycling system in accordance with an exemplary embodiment.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

When referring to any numerical range of values herein, such ranges are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

Inking systems or inker subsystems in accordance with embodiments may be incorporated into a digital offset architecture so that the inking system is arranged about a central imaging plate, also referred to as "imaging member". The imaging member may be a cylinder or drum. A surface of the imaging member is reimageable making the imaging member a digital imaging member. The surface is also conformable. The conformable surface may comprise, for example, silicone. A paper path architecture may be situated about the imaging member to form a media transfer nip.

Dampening fluid vapor systems and methods are disclosed in U.S. Pat. No. 9,387,661 (the '661 patent) that may include a dampening fluid manifold delivery system. The dampening fluid manifold delivery system disclosed in the '661 patent may have an operating supply chamber diameter to printing area surface width ratio of less than 0.8. Mixed air and dampening fluid vapor may be caused to flow through a main supply chamber, and may be discharged onto a 100 mm wide reimageable surface of the imaging member at an angle of less than 30 degrees, for example, with a substantially uniform dampening fluid concentration, a substantially uniform mixture velocity, and a substantially uniform elevated temperature. Exemplary mixing systems are disclosed in U.S. Pat. No. 9,227,389 (the '389 patent) that may include a mixing device that mixes air and dampening fluid vapor that flows through the main supply chamber of the dampening fluid manifold delivery system.

The mixed air and dampening fluid vapor may be introduced onto the imaging member surface at an angle of less than 30 degrees to minimize direct impingement of the elevated temperature jetted dampening fluid vapor into the reimageable surface in a manner that may detrimentally affect the reimageable surface or that may fail to promote even deposition of the dampening fluid on the reimageable surface. The introduction of the mixture onto the reimageable surface of the imaging member may be in a same substantially tangential direction as the rotation of the imaging member. As such, a speed of rotation of the reimageable surface of the imaging member may be maintained at, for example, 1000 mm/sec. A width of the imaging member surface or printing area may be modified by adjusting the manifold dimensions while maintaining a diameter to width ratio of less than 0.8.

In examples, a dampening fluid deposition subsystem may include a supply manifold. The supply manifold may include a supply chamber. The supply manifold may include a supply channel. The supply channel may be configured to enable flow of dampening fluid from the supply chamber to the supply channel. In particular, the supply chamber may include an interior portion that contains dampening fluid. The supply chamber may be formed in a tube shape, for example, and may be configured to communicate with a dampening fluid supply for receiving dampening fluid.

The supply chamber may be constructed and configured to communicate with an interior of the supply chamber. The supply chamber may be configured to define an interior for containing dampening fluid, and may be connected to the supply chamber at a first end of the supply channel. An interior of the channel may communicate with a surface of an imaging member or plate in a printing system in which the dampening fluid deposition system is operably configured. Dampening fluid vapor may be delivered to an interior of the supply chamber at a first end of the supply chamber. The dampening fluid vapor may flow from the first end of the supply chamber to one or more openings for communicating with a supply channel. The dampening fluid may flow from the supply chamber, through the supply channel, and out of the supply channel onto, for example, a surface of an imaging member to form a dampening fluid layer.

In a digital evaporation step, particular portions of the dampening fluid layer applied to the surface of the imaging member may be evaporated by a digital evaporation system. For example, portions of the fountain solution layer may be vaporized by laser patterning to form a latent image. It has been found that during laser exposure, evaporated dampening fluid may need to be removed immediately. Otherwise, vaporized dampening fluid may re deposit onto the plate causing image quality problems such as voids in the applied ink layer. To enable desired removal and recovery of dampening fluid vapor from an imaging area of an imaging member surface during printing, it has been found that vacuum flow must be directed from the imaging member surface without impinging upon the surface.

A dampening fluid recovery system for ink-based digital printing is disclosed in U.S. Pat. No. 9,019,329 (the '329 patent) that enables effective removal, control, and recovery of dampening fluid during a printing process. In the '329 patent, a dampening fluid recovery system is provided that includes a vacuum and a vacuum flow path. The vacuum flow path is contoured, and the contour is configured to enable an increase in flow speed without impinging on the imaging surface.

In examples, dampening fluid recovery subsystems may include a vacuum flow path contoured to reduce a flow cross-sectional area at a vapor source location on the imaging member surface in comparison with other locations of the imaging member surface. Recovery systems in accordance with embodiments enable ink-based digital printing while minimizing streaks in the printed image, and enhancing image quality.

In another example, dampening fluid recovery subsystems may include a vacuum flow path contoured to reduce a flow cross-sectional area at a vapor source location on the imaging member surface. Further, systems may include a channel formed to enable low flow impedance and uniform flow distribution, wherein the channel is configured to reduce a flow cross-sectional area at the vapor source location on the imaging member surface. Accordingly, systems may be configured to print at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

FIG. 1 shows a dampening fluid recycling system in accordance with an exemplary embodiment. In particular, FIG. 1 shows a dampening fluid recycling system 10 including a dampening fluid deposition subsystem 12 and a dampening fluid recovery subsystem 14. The dampening fluid deposition subsystem 12 may apply a layer of dampening fluid onto a reimageable surface 16 of an imaging member 18. The dampening fluid recovery subsystem 14 may remove excess dampening fluid vapor adjacent the reimageable surface. The recycling system 10 may include at least one dampening fluid recycling station 20, each recycling station suitable for ink-based digital lithographic printing onto a print media 22 moving in a process direction 24, where each recycling station may include an inker subsystem and a digital evaporation system, as well understood by a skilled artisan, to form a respective print station that may apply a respective ink image onto the print media at a media transfer nip 26.

The deposition subsystem 12 and recovery subsystem 14 may be made by injection molding, and/or 3D printing, for example. The subsystems may be made from a combination of materials including Acrylnitride-Butadiene-Stryrene (ABS), Polycarbonate (PC), Polypropylene (PP), Acrylnitride-Butadiene-Stryrene (ABS), Polystyrene (GPPS), Machined aluminum, 3D printed aluminum and other materials that provide the desired structural capabilities as understood by a skilled artisan.

Figure 2:
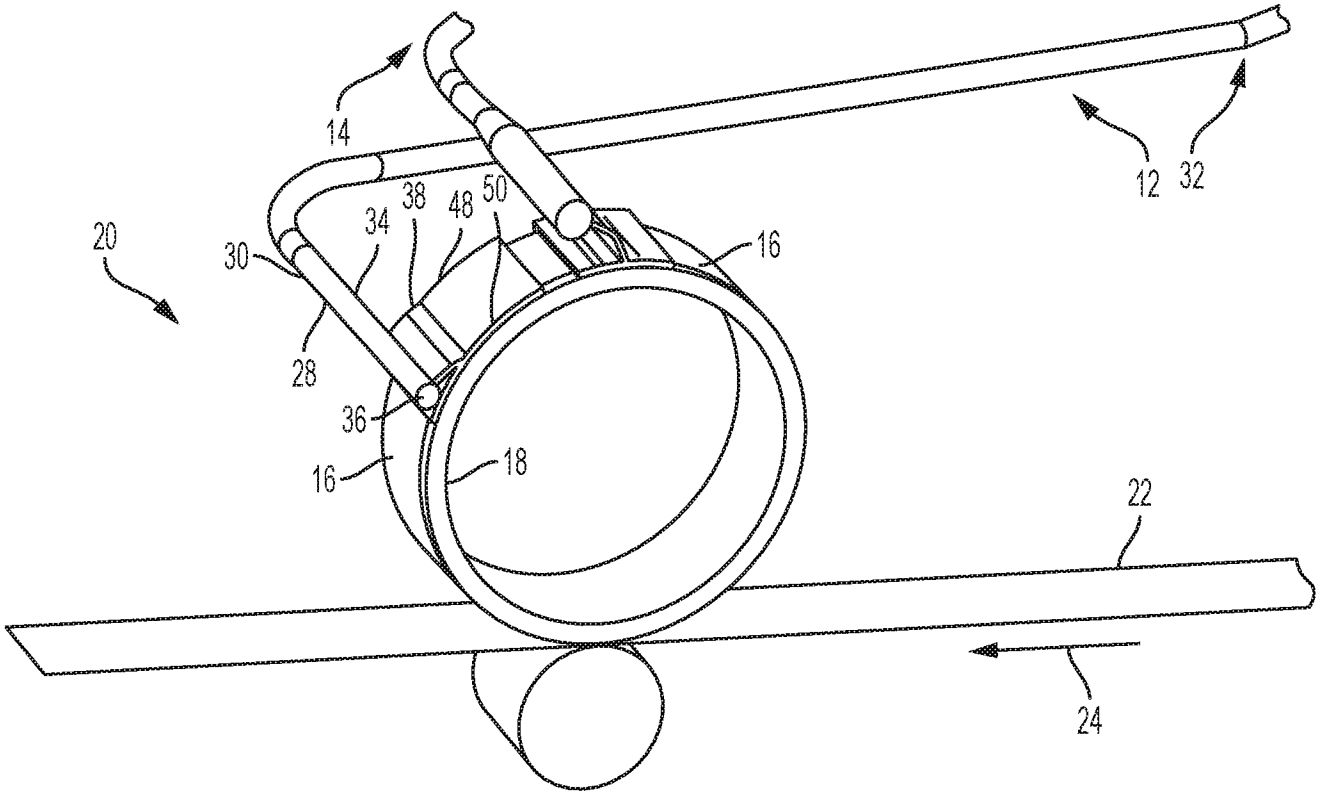
FIG. 2 shows a perspective view of an exemplary dampening fluid recycling station of the dampening fluid recycling system of FIG. 1.

FIG. 2 depicts an exemplary dampening fluid recycling station 20 of the dampening fluid recycling system 10. The dampening fluid deposition subsystem 12 at the recycling station 20 may include a supply chamber 28. The supply chamber 28 may be configured in the shape of a tube, for example. The supply chamber 28 may define an interior for containing fluid such as dampening fluid suitable for ink-based digital lithographic printing. The supply chamber 28 includes an inlet tube 30 in contact with a dampening fluid source 32 and a tube portion 34 extending to a closed distal end 36 thereof. The supply chamber 28 may be connected to a dampening fluid supply (not shown) for receiving dampening fluid in the interior of the supply chamber.

Figure 3:
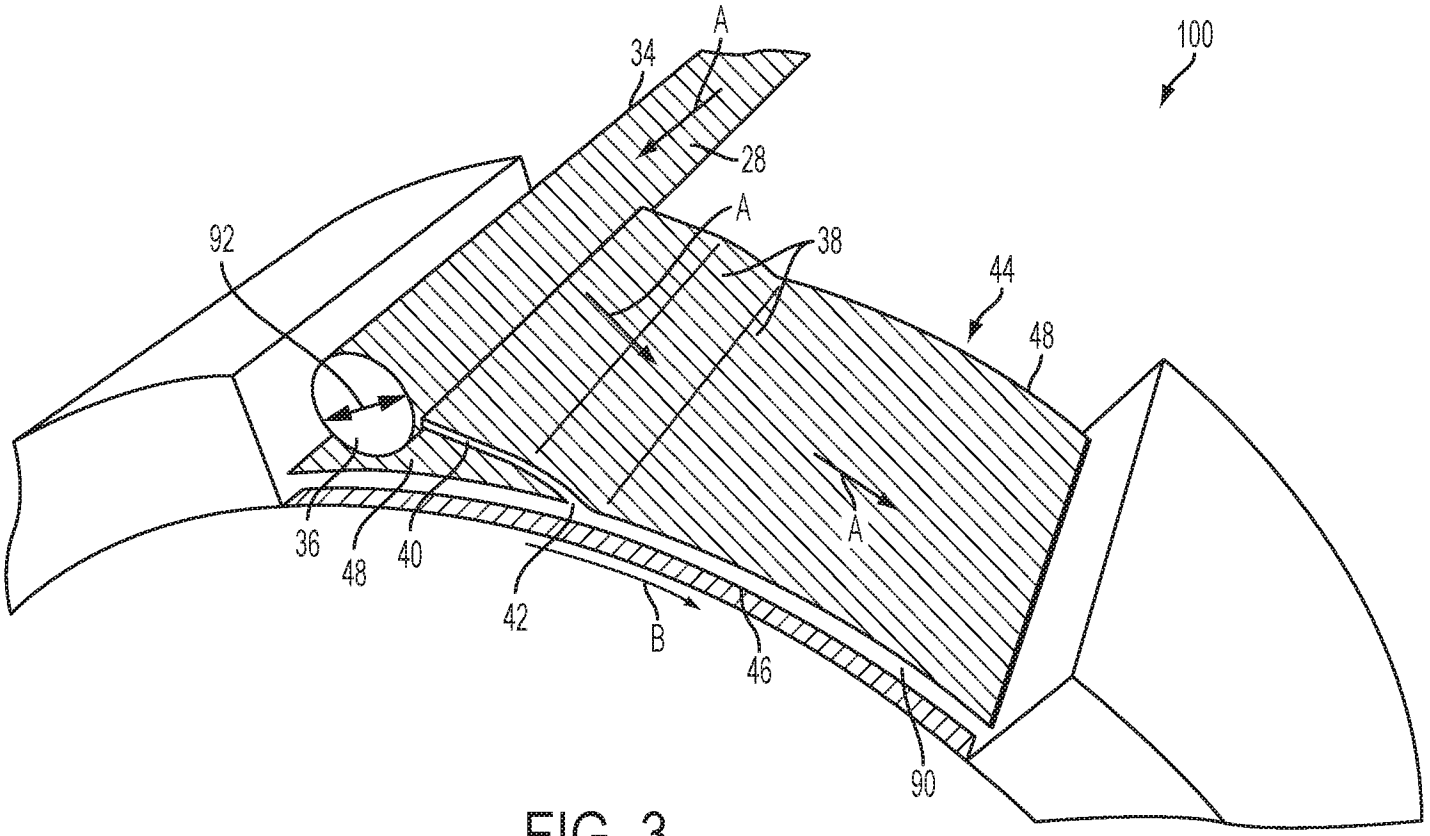
FIG. 3 shows a perspective view of a dampening fluid deposition subsystem in accordance with an exemplary embodiment.

FIG. 3 depicts the dampening fluid deposition subsystem 12 at the recycling station 20. As can be seen in FIGS. 2 and 3, the dampening fluid deposition subsystem 12 may include a supply channel 38. The supply channel 38 may define an interior 40 (FIG. 3). The interior of the supply channel 38 may communicate with the interior of the supply chamber 28 to enable flow of dampening fluid vapor from the supply chamber to the supply channel. Dampening fluid vapor may be caused to flow in a direction of arrows A, through the supply chamber 28, to the supply channel 38, and through the supply channel for depositing onto the surface 16 of the imaging member 18, for example, at a supply channel outlet 42 configured to enable the supply chamber interior to communicate with the reimageable surface 16. The supply channel 28 may be configured to deposit dampening fluid vapor onto the surface 16 with uniform dampening fluid concentration, mixture velocity, and temperature. The reimageable surface 16 of the imaging member may include a printing area having a width parallel to the supply channel 38, with the supply channel outlet 42 configured to enable the supply chamber 28 interior to communicate with the reimageable surface 16 of the imaging member along the width of the printing area.

A vapor flow restriction border 44 extends from the supply channel 38 adjacent the reimageable surface 16 to confine dampening fluid vapor provided from the supply channel outlet 42 to a condensation region 46 defined by the restriction border and the adjacent reimageable surface to support forming a layer of dampening fluid on the reimageable surface via condensation of the dampening fluid vapor onto the reimageable surface. The restriction border 44 defines the condensation region 46 over the surface 16 of the imaging member. The restriction border includes arc walls 48 that face the imaging member surface, and border wall 50 (FIG. 2) that extend from the arc walls towards the imaging member surface.

Figure 4:
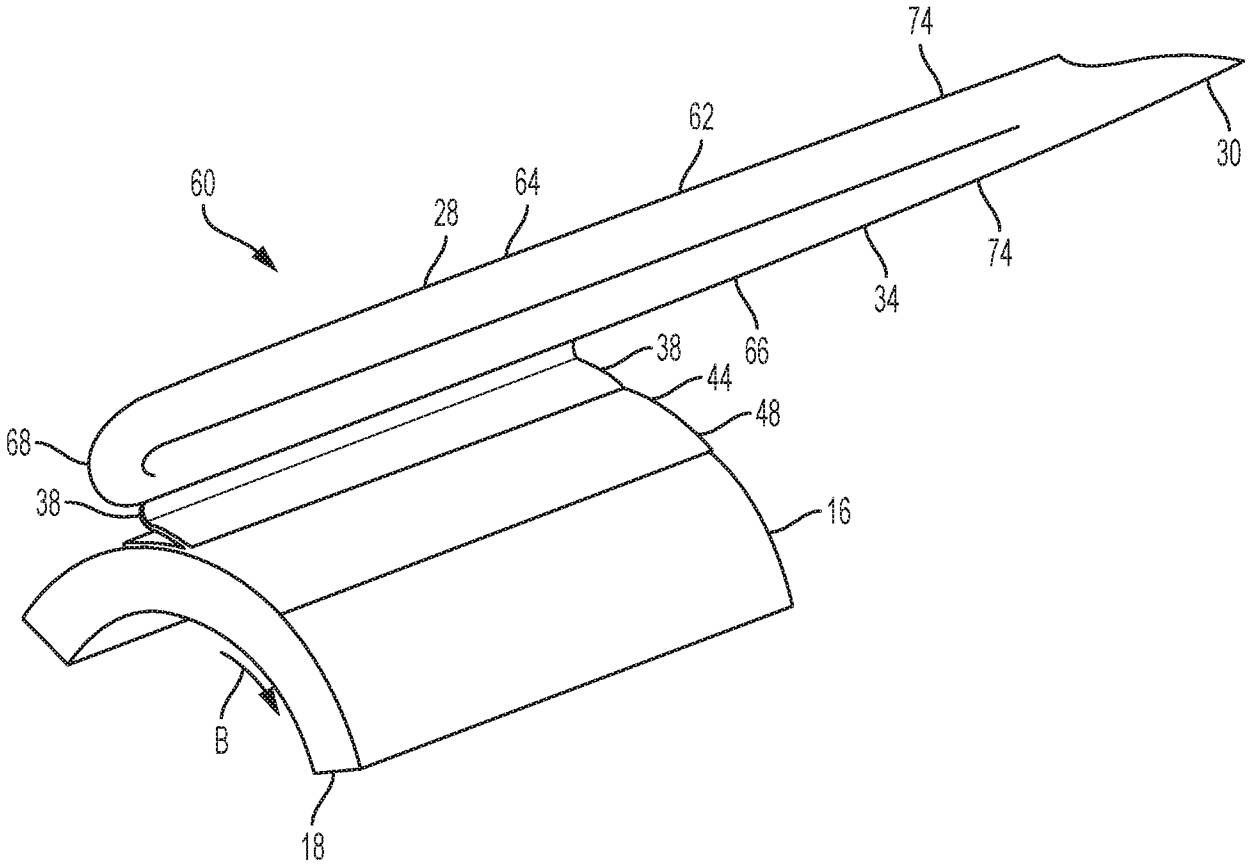
FIG. 4 shows a perspective view of a dampening fluid deposition subsystem in accordance with another exemplary embodiment.
Figure 5:
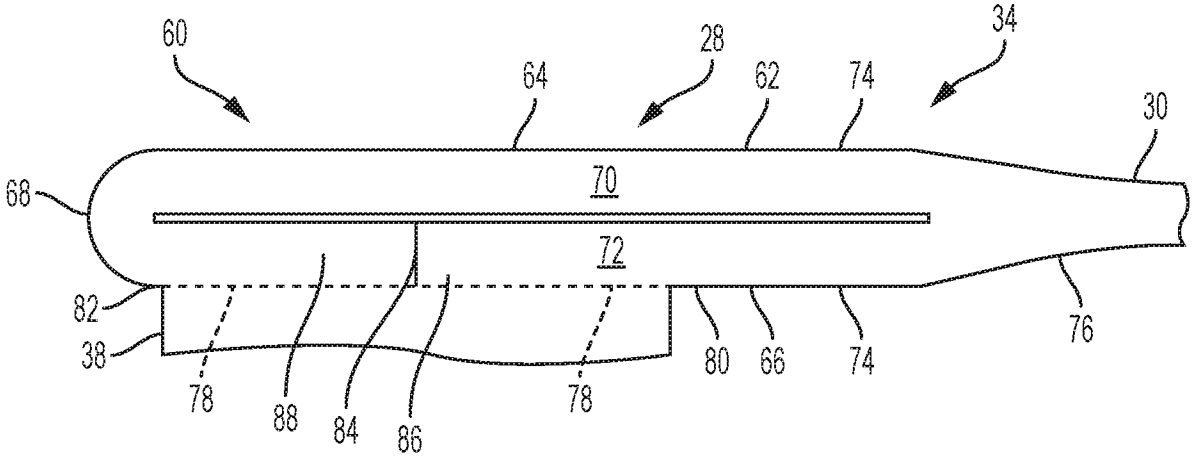
FIG. 5 is a sectional view of the dampening fluid deposition subsystem of FIG. 4.

FIGS. 4 and 5 depict another example of a dampening fluid deposition subsystem 60 at the recycling station 20. The dampening fluid deposition subsystem 60 is substantially similar to the dampening fluid deposition subsystem 12, with the tube portion 34 of the supply chamber 28 having a split tube 62. The split tube 62 may include a first split tube portion 64 and a second split tube portion 66 extending to a closed distal end 68 of the split tube. The tube portion 34 splits into the first and second split tube portions 64, 66 adjacent the inlet tube 30; and the split tube portions rejoin at the closed distal end. The first split tube portion 64 defines a first split tube portion interior 70, and the second split tube portion 66 defines a second split tube portion interior 72, the first split tube portion being in fluid communication with the second split tube portion at both the inlet tube 30 and the distal end 68. The first and second split tube portion interiors 70, 72 are in fluid communication with the interior 40 of the supply channel 38. Thus dampening fluid flowing through the first and second split tube portion interiors 70, 72 may flow through the interior 40 onto the reimageable surface 16 of the imaging member 18.

While not being limited to a particular theory, the first and second split tube portion interiors 70, 72 may be configured with the same cross sectional area for flow uniformity between the chambers. Flow uniformity may be achieved by reducing the area ratio between the outlet flow areas of the split tube 62 (e.g., at reference number 74) and the inlet flow area of the inlet tube 30 (e.g., at reference number 76). The first and second split tube portions 64, 66 may provide a low area ratio (e.g., less than half, 0.35 to 0.5) compared to the inlet tube 30 while maintaining a tube diameter smaller than the inlet tube. While not being limited to a particular theory, an area ratio of 0.5 may be preferred for a print width of about 14 inches (355.6 mm). Area ratios of about 0.35 to 0.5, or 0.2 to 0.5 are contemplated with the understanding that as the area ratio decreases the diameter of the supply tubes increase.

Referring to FIG. 5, the second split tube portion 66 is attached to the supply channel 38, and includes an opening 78 between the second split tube portion interior 72 and the interior 40 of the supply channel 38 for fluid communication therebetween. The opening 78 may extend the length of the interior as an elongated slot, or any number of slots sized as desired for the uninterrupted flow of dampening fluid vapor from the second split tube portion interior 72 and the interior of the supply channel. During operation, dampening fluid vapor may flow from the inlet tube 30 through the second split tube portion interior 72 into the interior 40 of the supply channel 38 and onto the reimageable surface 16 of the imaging member 18. Dampening fluid vapor may also flow from the inlet tube 30 through the first split tube portion interior 70 and the second split tube portion interior 72 at the distal end 68 into the interior of the supply chamber and onto the reimageable surface of the imaging member.

The second split tube portion 66 may include a first section 80 proximate the inlet tube 30 and a second section 82 proximate the closed distal end 68. In this example, the first section 80 may extend from the inlet tube to the second section 82, and the second section may extend from the first section to the first split tube portion 64 at the distal end. The first and second sections may connect at an interior wall 84. The interior wall may extend across the second split tube portion interior 72 and separate the second split tube portion interior into two sub-chambers 86 and 88. In this manner, the interior wall 84 is configured to block dampening fluid communication within the second split tube portion interior 72 directly between the sub-chambers. The interior wall 84 may help provide vapor flow uniformity from the split tube 62 to the supply channel 38.

As can best be seen in FIGS. 2-4, the dampening fluid deposition subsystems 12, 60 may be configured in an ink-based digital printing system for depositing dampening fluid on a the surface 16 or reimageable printing plate of the imaging member 18. In particular, the interior of the supply channel 28 may be configured to communicate with the surface 16 of the imaging member to deliver dampening fluid vapor to the surface at an angle of 30 degrees or less, and in the same tangential direction as the rotating imaging member. As the surface 16 of the imaging member rotates in a process direction B, dampening fluid is caused to flow from the interior of the supply channel 38 to the surface of the imaging member 18. Preferably, a ratio of the cross sectional area of the supply channel 38 to the cross sectional area of the supply chamber is about 0.8.

Referring back to FIG. 3, a gap 90 between the surface 16 of the imaging member 18 and the vapor flow restriction border 44 may be 1.735 mm. The gap 90 may be in the range of 1 mm to 3.0 mm, and a gap in the range of 1 mm to 2 mm may be preferred. A diameter 92 of the supply chamber 28 may be 20 mm. A width of the supply channel 38 may be 1.735 mm to maintain an area ratio of 0.8 with diameter 92 of the supply channel at 20 mm. A width of the printing area shown in FIGS. 2 and 3 may be about 100 mm.

Referring to FIGS. 4 and 5, a diameter of the first and second split tube portions 64, 66 may be about 10 mm. The inventor has found that with the split tube 62, the width of the printing area may be widened to over 355.6 mm (14 inches) while maintaining uniform vapor concentration across the width. It has also been found that a width of the printing plate surface may be widened by adjusting manifold dimensions, but maintaining the cross sectional area of the supply channel to the cross sectional area of the tubular supply chamber of about 0.5, of less than 0.5, or of a range from 0.35 to 0.5. Further, it has been found that configurations in accordance with embodiments enable uniform concentration and volume far downstream of the manifold exit during vapor deposition, which enables the condensation region 46 for dampening fluid to form by condensing dampening fluid vapor.

Accordingly, systems may be configured for enhanced printing at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

Figure 6:
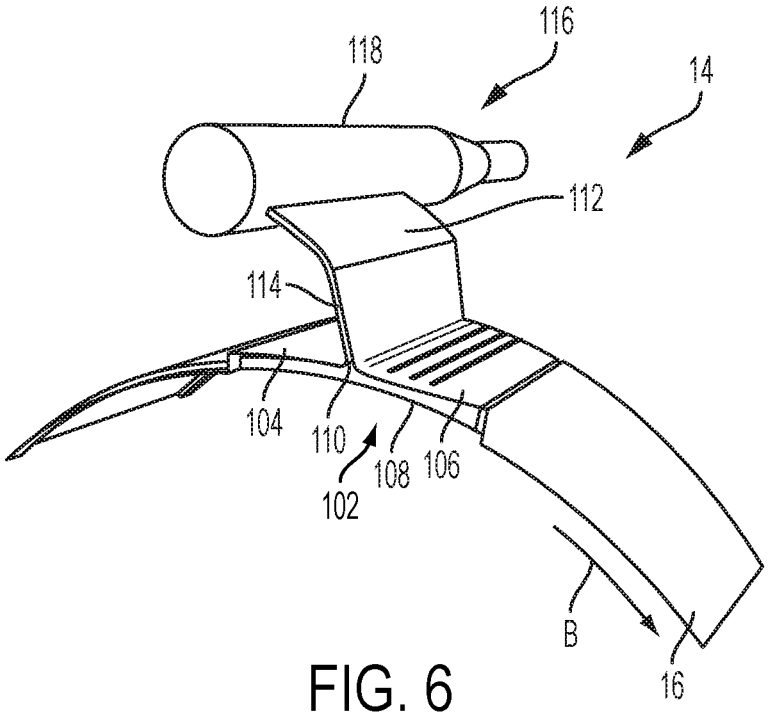
FIG. 6 shows perspective view of a dampening fluid recovery subsystem.

FIG. 6 depicts an exemplary dampening fluid recovery subsystem 14. In particular, the dampening fluid recovery subsystem dampening fluid recovery subsystem 14 is located downstream the dampening fluid deposition subsystem in the rotational processing direction of the imaging member 18, and is configured to remove excess dampening fluid vapor that does not condense over the reimageable surface within the condensation region 46 (FIG. 3). The dampening fluid recovery subsystem may include a seal unit 102 that covers the reimageable surface 16 downstream the condensation region. The seal unit 102 preferably does not physically touch the imaging member as this may cause undesired friction with the imaging member, which rotates in the process direction B during printing. The seal unit 102 may include cover walls 104, 106 disposed at an evaporation location over the surface of the imaging member and border wall 108 that extend from the cover walls towards the imaging member surface. The cover walls face the imaging member surface 16, and are contoured to define an air flow channel 108 between the walls and the imaging member surface at the evaporation location. The cover walls 104, 106 also form a vapor inlet 110 at a vapor extraction channel 112 coupled to the cover walls. The vapor extraction channel 112 defines a vapor extraction channel interior 114 in communication with the air flow channel 108. As can be seen in FIG. 6, the vapor extraction channel 112 may ascend away from the imaging member 18 to deliver the excess dampening fluid vapor from the air flow channel 108.

The dampening fluid recovery subsystem 14 may further include a vapor extraction manifold 116 including a vapor extraction chamber 118 defining a vapor extraction chamber interior in communication with the vapor extraction channel interior 114 to collect the excess dampening fluid vapor from the vapor extraction channel 112. The vapor extraction manifold 116 may further including a vapor condensation device 120 (FIG. 8) specifically designed to cool the excess dampening fluid vapor into a fluid state, with the cooled dampening fluid then recycled back to the dampening fluid source 32 (FIG. 7).

Figure 7:
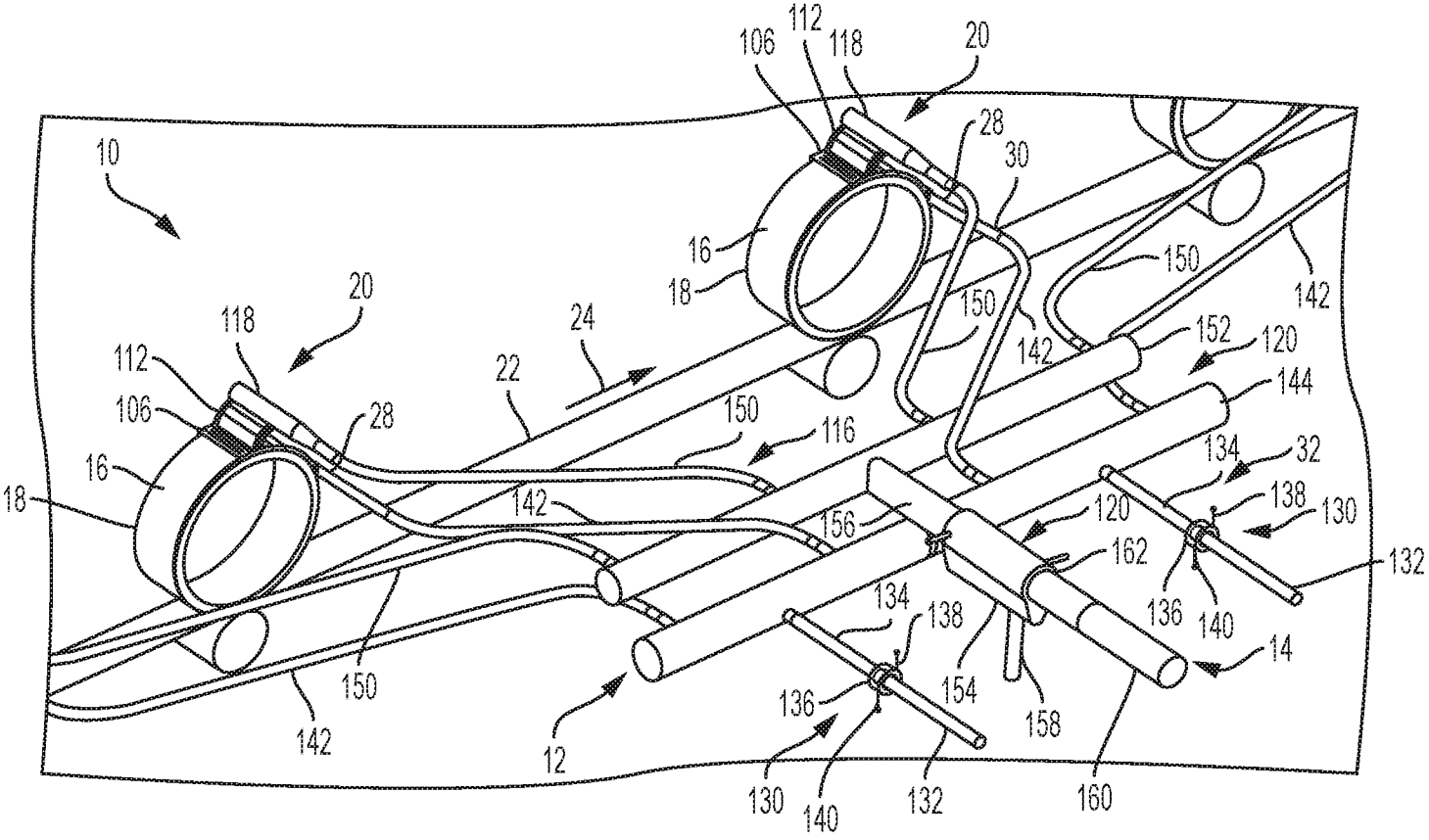
FIG. 7 shows an expanded perspective view of the exemplary dampening fluid recycling system illustrated in FIG. 1.
Figure 8:
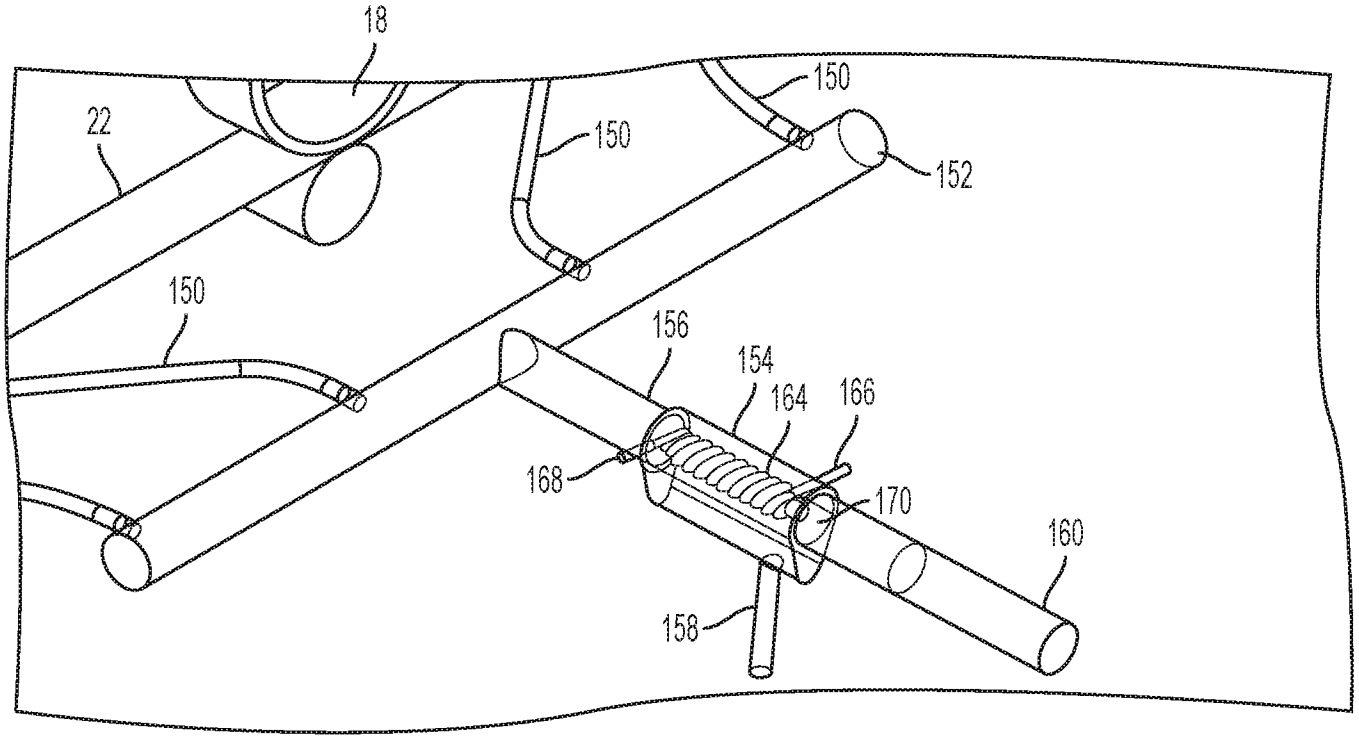
FIG. 8 shows an expanded perspective view of the dampening fluid recovery system illustrated in FIG. 1.

FIG. 7 depicts the exemplary dampening fluid recycling system 10 of FIG. 1 in expanded view. As can be seen in FIGS. 1 and 7, the recycling system 10 may include at least one dampening fluid recycling station 20. Each recycling station may include an imaging member 18, a dampening fluid supply chamber 28, a dampening fluid supply channel 38, a dampening fluid supply channel outlet 42, a vapor flow restriction border 44, a seal unit 102, a vapor extraction channel 112 and a vapor extraction chamber 118. The dampening fluid deposition subsystem may further include a dampening fluid distribution manifold 120 that connects each dampening fluid supply chamber 28 from each dampening fluid recycling station 20 to the dampening fluid source 32. The dampening fluid distribution manifold 120 may include distribution finger conduits 142 that couple the supply chambers 28 to a central distribution manifold conduit 144 that may be coupled to the dampening fluid source 32.

The dampening fluid source 32 is configured to provide a flow of dampening fluid vapor to each supply chamber 28 via the dampening fluid distribution manifold 120. An exemplary dampening fluid source may include one or more air/vapor mixing apparatuses 130, with each including an air only flow inlet 132 into which air may be introduced at a controlled mass flow rate. The introduced air may also have an elevated temperature (e.g., 100° C.-170° C., about 150° C.). For example, the air may be introduced into the air/vapor mixing apparatus 130 at a mass flow rate of about 5.5×10-4 kg/s. The air/vapor mixing apparatus 130 may include a vapor flow exit 134 through which the air and dampening fluid vapor mixture may be directed through the dampening fluid distribution manifold 120 to respective dampening fluid supply chambers 28. A dampening fluid vapor introduction chamber 136 may be disposed at a point along the air/vapor mixing apparatus 130 between the air only flow inlet 132 and the vapor flow exit 134.

The dampening fluid vapor introduction chamber 136 may include a plurality of dampening fluid vapor chamber inlets 138, 140. The plurality of dampening fluid vapor chamber inlets 138, 140 are configured to communicate with the dampening fluid vapor introduction chamber 136 so that introduced dampening fluid vapor may flow through the plurality of dampening fluid vapor chamber inlets 138, 140 to the dampening fluid vapor introduction chamber 136. For example, a D4 vapor may be introduced through the plurality of dampening fluid vapor chamber inlets 138, 140 to the dampening fluid vapor introduction chamber 136 for further introduction into the airstream in the air/vapor mixing apparatus 130 at a mass flow rate of about 6.9×10-5 kg/s.

As can be seen in FIG. 7, the vapor extraction manifold 116 may include a series of conduits that provide fluid communication between the vapor extraction channel interior 114 through the vapor condensation device 120. The series of conduits may include finger conduits 150 that couple the vapor extraction chamber 118 to a central extraction manifold conduit 152 that may be coupled to the vapor condensation device 120. The vapor condensation device 120 is configured to condense the excess dampening fluid vapor removed from the air flow channel 108 by the dampening fluid recovery system 14 into liquid. The liquid may be transferred back to the dampening fluid source 32.

An exemplary vapor condensation device 120 may include a coolant housing 154 having an inlet conduit 156 that may couple to the vapor extraction manifold 116, for example, at the central extraction manifold conduit 150 thereof, to transfer excess dampening fluid vapor to the coolant housing. The coolant housing 154 may also have a liquid outlet 158 that collects condensed dampening fluid liquid from the coolant housing. The collected dampening fluid liquid may be filtered, and transferred to the dampening fluid source 32 for reuse. A vacuum conduit 160 may connect to an outlet end 162 of the coolant housing 154, and extend to a vacuum source that provides a vacuum to pull the excess dampening fluid vapor from the vapor extraction channel interior 114 through the vapor extraction manifold 116 and the coolant housing 154 as well understood by a skilled artisan.

FIG. 9 shows the coolant housing 154 in expanded view. Within the coolant housing 154, vapor condensation device 120 may include a cooling unit, for example, a coolant conduit 164 with an inlet 166 and an outlet 168. In operation, a coolant may flow from the inlet 166 through the coolant conduit 164 and outlet 168 to lower the temperature of the interior of the coolant housing 154. This cooled interior may condense the excess dampening fluid vapor into dampening fluid liquid, which then exits the coolant housing 154 via the liquid outlet 158. The coolant conduit 164 may be wrapped as a coil around a cooper core 170. During operation, the coolant conduit 164 may lower the temperature of the cooper core 170, which can increase the cooling of the interior of the coolant housing 154 to temperatures that increase the condensation rate of the excess dampening fluid vapor in the housing.

Those skilled in the art will appreciate that other embodiments of the disclosed subject matter may be practiced with many types of image forming elements common to offset inking system in many different configurations. For example, although digital lithographic systems and methods may be shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A dampening fluid delivery system useful for printing with an ink-based digital image forming apparatus having an imaging member with a reimageable surface, the system comprising:

a dampening fluid supply chamber having a dampening fluid supply chamber interior, the dampening fluid supply chamber including an inlet tube in contact with a dampening fluid source and a tube portion extending to a closed distal end thereof with the dampening fluid source configured to provide dampening fluid in a vapor state to the reimageable surface, the dampening fluid supply chamber interior defined by the inlet tube and the tube portion, the tube portion having a first split tube portion and a second split tube portion extending to the closed distal end of the split tube, with the first and second split tube portions joining at the closed distal end, the first split tube portion defining a first split tube portion interior, the second split tube portion defining a second split tube portion interior, the first split tube portion interior being in fluid communication with the second split tube portion interior at both the inlet tube and the distal end;

a dampening fluid supply channel defining a dampening fluid supply channel interior in communication with the dampening fluid supply chamber interior, the dampening fluid supply channel descending towards the imaging member, the dampening fluid supply channel being configured to deliver fluid vapor from the dampening fluid supply chamber interior onto the reimageable surface of the imaging member;

a dampening fluid supply channel outlet configured to enable the dampening fluid supply chamber interior to communicate with the reimageable surface of the imaging member; and a vapor flow restriction border configured to confine dampening fluid vapor provided from the dampening fluid supply channel outlet to a condensation region to support forming the layer of dampening fluid on the reimageable surface via condensation of the dampening fluid vapor over the reimageable surface.

2. The system of claim 1, further comprising a dampening fluid recovery subsystem configured to remove excess dampening fluid vapor that does not condense over the reimageable surface within the condensation region, the dampening fluid recovery subsystem including:

a seal unit having a front seal portion, the front seal portion having an upper wall facing the reimageable surface, the upper wall being configured to define an air flow channel with the reimageable surface;

a vapor extraction channel defining a vapor extraction channel interior in communication with the air flow channel, the vapor extraction channel ascending away from the imaging member to deliver the excess dampening fluid vapor from the air flow channel; and a vapor extraction manifold including a vapor extraction chamber defining a vapor extraction chamber interior in communication with the vapor extraction channel interior to collect the excess dampening fluid vapor from the vapor extraction channel, the vapor extraction manifold further including a vapor condensation device configured to cool the excess dampening fluid vapor into a fluid state, the vapor extraction manifold including a dampening fluid output conduit configured to deliver the cooled dampening fluid to the dampening fluid source.

3. The system of claim 1, the dampening fluid supply channel being configured to deliver fluid vapor from both the first split tube portion and the second split tube portion onto the reimageable surface of the imaging member.

4. The system of claim 3, the second split tube portion including a first section proximate the inlet tube, a second section proximate the closed distal end, and an interior wall between the first and second sections, the interior wall extending across the second split tube portion interior, the interior wall configured to block dampening fluid communication within the second split tube portion interior between the first section and the second section.

5. The system of claim 1, the reimageable surface of the imaging member having a printing area having a width parallel to the dampening fluid supply channel, the dampening fluid supply channel outlet configured to enable the dampening fluid supply chamber interior to communicate with the reimageable surface of the imaging member along the width of the printing area.

6. The system of claim 5, wherein the width is at least 355 mm.

7. The system of claim 2, further comprising a vacuum source attached to the vapor extraction manifold, the vacuum source configured to move the excess dampening fluid vapor from the air flow channel to the vapor condensation device.

8. The system of claim 7, the vapor extraction manifold including a vacuum tube between the vapor condensation device and the vacuum source, the vacuum tube being different than the dampening fluid output conduit.

9. The system of claim 2, the vapor condensation device including a coolant conduit with an input and an output, the coolant conduit housing coolant flowing from the inlet to the outlet thereof.

10. The system of claim 9, the vapor condensation device further including a copper core, wherein the coolant conduit is a coil wrapped around the copper core.

11. The system of claim 2, further comprising a dampening fluid distribution manifold attached between the dampening fluid source and the dampening fluid supply chamber, wherein the dampening fluid supply chamber, the dampening fluid supply channel, the dampening fluid supply channel outlet, the vapor flow restriction border, the seal unit and the vapor extraction channel form a first print station configured to print a first image onto a print substrate moving in a process direction, the dampening fluid delivery system further comprising a second print station configured to print a second image related to the first image onto the print substrate downstream the first print station, the second print station including:

a second dampening fluid supply chamber having a dampening fluid supply chamber interior, the second dampening fluid supply chamber including a second inlet tube in contact with the dampening fluid source and a second tube portion extending to a closed second distal end thereof, the dampening fluid supply chamber interior defined by the second inlet tube and the second tube portion, a second dampening fluid supply channel defining a second dampening fluid supply channel interior in communication with the second dampening fluid supply chamber interior, the second dampening fluid supply channel descending towards a second imaging member, the second dampening fluid supply channel being configured to deliver fluid vapor from the second dampening fluid supply chamber interior onto a second reimageable surface of the second imaging member, a second dampening fluid supply channel outlet configured to enable the second dampening fluid supply chamber interior to communicate with the second reimageable surface, a second vapor flow restriction border configured to confine dampening fluid vapor provided from the second dampening fluid supply channel outlet to a second condensation region to support forming the layer of dampening fluid on the second reimageable surface via condensation of the dampening fluid vapor over the second reimageable surface, a second seal unit having a second front seal portion, the second front seal portion having a second upper wall facing the second reimageable surface, the upper wall being configured to define a second air flow channel with the second reimageable imaging surface, and a second vapor extraction channel defining a second vapor extraction channel interior in communication with the second air flow channel, the second vapor extraction channel ascending away from the second imaging member to deliver the excess dampening fluid vapor from the second air flow channel to the vapor extraction manifold, wherein the vapor extraction manifold is further configured to collect the excess dampening fluid vapor from the second vapor extraction channel, to cool the excess dampening fluid vapor into a fluid state, and to deliver the cooled dampening fluid to the dampening fluid source.

12. A dampening fluid delivery system useful for printing with an ink-based digital printing system, the ink-based digital printing system having an imaging member with a reimageable surface, the system comprising:

a dampening fluid supply chamber having a dampening fluid supply chamber interior, the dampening fluid supply chamber including an inlet tube and a split tube having a first split tube portion and a second split tube portion extending to a closed distal end of the split tube, the inlet tube coupled to a dampening fluid supply source, the inlet tube extending from the fluid supply source and splitting into the first split tube portion and the second split tube portion, the first and second split tube portions rejoining at the closed distal end, the dampening fluid supply chamber interior defined by the inlet tube and the split tube, the first split tube portion defining a first split tube portion interior, the second split tube portion defining a second split tube portion interior, the first split tube portion interior being in fluid communication with the second split tube portion interior at both the inlet tube and the distal end; and a dampening fluid supply channel attached to the split tube, the dampening fluid supply channel defining a dampening fluid supply channel interior in communication with the dampening fluid supply chamber interior, the dampening fluid supply channel being configured to deliver fluid vapor from both the first split tube portion and the second split tube portion onto the reimageable surface of the imaging member.

13. The system of claim 12, further comprising a dampening fluid supply channel outlet configured to enable the dampening fluid supply chamber interior to communicate with the reimageable surface of the imaging member.

14. The system of claim 12, the second split tube portion including a first section proximate the inlet tube, a second section proximate the closed distal end, and an interior wall between the first and second sections, the interior wall extending across the dampening fluid supply chamber interior, the interior wall configured to block dampening fluid communication within the fluid supply chamber interior between the first section and the second section.

15. The system of claim 12, the reimageable surface of the imaging member including a printing area having a width parallel to the dampening fluid supply channel, the dampening fluid supply channel outlet configured to enable the dampening fluid supply chamber interior to communicate with the reimageable surface of the imaging member along the width of the printing area.

16. A dampening fluid delivery system useful for printing with an ink-based digital image forming apparatus having an imaging member with a reimageable surface and a dampening fluid deposition subsystem for applying a layer of dampening fluid from a dampening fluid source in vapor form over the reimageable surface with the dampening fluid vapor condensing onto the reimageable surface, the dampening fluid delivery system comprising:

a dampening fluid recovery subsystem configured to transfer excess dampening fluid vapor from over a reimageable surface of an imaging member to a dampening fluid source, the dampening fluid recovery subsystem including:

a seal unit having a front seal portion, the front seal portion having an upper wall facing the reimageable surface, the upper wall being configured to define an air flow channel with the reimageable surface, a vapor extraction channel defining a vapor extraction channel interior in communication with the air flow channel, the vapor extraction channel ascending away from the imaging member to deliver the excess dampening fluid vapor from the air flow channel, and a vapor extraction manifold including a vapor extraction chamber defining a vapor extraction chamber interior in communication with the vapor extraction channel interior to collect the excess dampening fluid vapor from the vapor extraction channel, the vapor extraction manifold further including a vapor condensation device configured to cool the excess dampening fluid vapor into a fluid state, the vapor extraction manifold including a dampening fluid output conduit configured to deliver the cooled dampening fluid to the dampening fluid source.

17. The system of claim 16, further comprising a vacuum source attached to the vapor extraction manifold, the vacuum source configured to move the excess dampening fluid vapor from the air flow channel to the vapor condensation device.

18. The system of claim 17, the vapor extraction manifold including a vacuum tube between the vapor condensation device and the vacuum source, the vacuum tube being different than the dampening fluid output conduit.

19. The system of claim 16, the vapor condensation device including a coolant conduit with an input and an output, the coolant conduit housing coolant flowing from the inlet to the outlet thereof.

20. The system of claim 19, the vapor condensation device further including a copper core, wherein the coolant conduit is a coil wrapped around the copper core.

* * * * *